US006847696B2

(12) United States Patent
Chinju et al.

(10) Patent No.: US 6,847,696 B2
(45) Date of Patent: Jan. 25, 2005

(54) SYNCHROTRON RADIATION MEASUREMENT APPARATUS, X-RAY EXPOSURE APPARATUS, AND DEVICE MANUFACTURING METHOD

(75) Inventors: Hideyuki Chinju, Shioya-Gun (JP); Yutaka Watanabe, Utsunomiya (JP); Akira Miyake, Utsunomiya (JP); Nobuaki Oqushi, Utsunomiya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/689,031

(22) Filed: Oct. 21, 2003

(65) Prior Publication Data

US 2004/0081272 A1 Apr. 29, 2004

Related U.S. Application Data

(62) Division of application No. 09/583,979, filed on May 31, 2000, now Pat. No. 6,665,371.

(30) Foreign Application Priority Data

Jun. 3, 1999 (JP) ..... 11-157038
Jun. 16, 1999 (JP) ..... 11-170050

(51) Int. Cl.[7] ..... G21K 5/00
(52) U.S. Cl. ..... 378/34; 378/19; 378/145
(58) Field of Search ..... 378/10, 19, 34, 378/113, 119, 137, 138, 145

(56) References Cited

U.S. PATENT DOCUMENTS

| | | | | |
|---|---|---|---|---|
| 4,734,685 | A | 3/1988 | Watanabe | 340/710 |
| 5,204,887 | A | 4/1993 | Hayashida et al. | 378/43 |
| 5,285,488 | A | 2/1994 | Watanabe et al. | 378/34 |
| 5,444,758 | A | 8/1995 | Miyake et al. | 389/113 |
| 5,448,612 | A | 9/1995 | Kasumi et al. | 378/84 |
| 5,835,560 | A | 11/1998 | Amemiya et al. | 378/34 |
| 5,930,324 | A | 7/1999 | Matsui et al. | 378/34 |
| 6,081,581 | A | 6/2000 | Hasegawa | 378/145 |
| 6,160,865 | A | 12/2000 | Ogushi | 378/34 |
| 6,385,497 | B1 | 5/2002 | Ogushi et al. | 700/110 |

*Primary Examiner*—David V. Bruce
*Assistant Examiner*—Courtney Thomas
(74) *Attorney, Agent, or Firm*—Fitzpatrick, Cella, Harper & Scinto

(57) ABSTRACT

A measurement apparatus has a first detector for measuring an intensity such that a sheet-shaped beam of synchrotron radiation is integrated over the entire range of the beam in the thickness direction thereof; a second detector for measuring the intensity of the beam at two points where positions along the direction are different; and a calculating device for calculating the magnitude of the beam in the direction on the basis of the detections by the first and second detectors.

4 Claims, 16 Drawing Sheets

SYNCHROTRON RADIATION MEASUREMENT APPARATUS, X-RAY EXPOSURE APPARATUS, AND DEVICE MANUFACTURING METHOD

This application is a division of application Ser. No. 09/583,979, Filed May 31, 2000, now U.S. Pat. No. 6,665, 371.

BACKGROUND OF THE INVENTION

1. Field of the Invention

The present invention relates to synchrotron radiation measurement technology which is suitably used in various types of apparatuses, such as spectroscopes, lithography apparatuses, X-ray microscopes, etc., using synchrotron radiation.

2. Description of the Related Art

Synchrotron radiation which is generated when charged particles which are accelerated to high speeds are deflected by a magnetic field may be obtained as a sheet-shaped beam which is concentrated in the plane of the trajectory of the charged particles. This beam has a nearly Gaussian intensity distribution with respect to a direction perpendicular to the plane of the trajectory of the charged particles. The divergence of this beam, that is, the thickness (the magnitude of the spread, the size in the thickness direction) of the sheet beam, depends on the acceleration energy of the charged particles, the intensity of the magnetic field, the size of the charged particle beam, the divergence angle of the charged particle beam, etc.

When measurement, processing, etc., is performed using synchrotron radiation, normally, a beam is deflected or concentrated using a mirror and is irradiated onto a specimen. The concentration position and the intensity of the beam irradiated onto the specimen depend on the position of the beam which enters a mirror, and the magnitude of the spread thereof. In order to determine the intensity and the position of the light to be irradiated onto the specimen and to adjust the radiation to an optimal value, it is necessary to measure the position and the size of the beam. Also, when the synchrotron light source is controlled so that the position of the beam and the magnitude of the spread thereof are maintained at predetermined values, it is necessary to measure the position of the beam and the magnitude of the spread thereof.

Conventionally, as a method for measuring a synchrotron radiation beam, a method using a detector such as that shown in FIG. 18 is known. This detector is located inside a vacuum container, and includes an aperture plate 35 in which a pin hole 34 is provided, a filter 16 located behind the aperture plate 35, and a photodiode 36, so that the position of a sheet-shaped beam 15 can be measured.

This detector is moved to scan in a Y direction with respect to the synchrotron beam so as to determine the beam profile. Fitting by an appropriate function, for example, a Gaussian function, is performed thereon in order to calculate the spread (magnitude) a of the beam and the position thereof in the Y direction. That is, as shown in FIG. 19, in the horizontal axis, the position Y of the X-ray detector is plotted, in the vertical direction, the output (light intensity) S of the X-ray detector is plotted, and the measured values are plotted. Then, in order that it coincide well with this measured value, $\sigma$ of the Gaussian distribution and the center value thereof are determined by performing Gaussian fitting such as that indicated by the solid line. More specifically, parameters of $\sigma$ of Gaussian and the center value are determined so that, for example, the sum of the squares of the differences between the assumed Gaussian and the measured values is minimized.

However, there are points to be improved, such as those described below. That is, according to this conventional example, in order to determine the position of the beam and the size thereof with high accuracy, it is necessary to set the Y position of the X-ray detector precisely at the time of measurement and to perform measurements repeatedly so as to obtain a substantial amount of data. The X-ray detector is driven in increments of, for example, 0.1 mm, and measurements are therefore performed at 101 points over 10 mm. At this time, since an operation for driving a very small distance for each measurement and then inputting the output of the X-ray detector must be repeatedly performed, the measurements take a long time. For example, even when the measurement of one point takes 0.1 second, 10 seconds or more is required for all the measurements. There may be cases where the position and the size of the synchrotron radiation beam vary over short periods, but such a conventional method cannot detect variations at such short periods.

Also, if the position and the size of the beam vary while the detector is made to scan to measure the beam profile, it is not possible to accurately measure the beam profile, causing errors to occur in the measured values of the position and the size of the beam.

SUMMARY OF THE INVENTION

An object of the present invention is to make improvements in such conventional technology. One object is to shorten the measurement time, and others are to reduce the power consumption of the apparatus, to increase the service life of the apparatus, and to prevent adverse influences, such as vibrations, etc., from being exerted on another measurement apparatus, in a synchrotron radiation measurement apparatus and method.

Other objects of the present invention are to quickly and accurately obtain the intensity distribution of exposure light on the surface of an exposed substrate in an X-ray exposure apparatus and method, and in a device manufacturing method.

To achieve the above-mentioned objects, according to a first aspect of the present invention, there is provided a measurement apparatus comprising: a first detector for measuring an intensity such that a sheet-shaped beam of synchrotron radiation is integrated over the entire range of the beam in the thickness direction thereof; a second detector for measuring the intensity of the beam at two points where positions along the thickness direction are different; and a calculator for calculating the magnitude of the beam in the thickness direction on the basis of the detections by the first and second detectors.

According to a second aspect of the present invention, there is provided a measurement method comprising the steps of: measuring an intensity such that a sheet-shaped beam of synchrotron radiation is integrated over the entire range of the beam in the thickness direction thereof; measuring the intensity of the beam at two points where positions along the thickness direction are different; and calculating the magnitude of the beam in the thickness direction on the basis of the respective measurements.

According to a third aspect of the present invention, there is provided an X-ray exposure apparatus comprising: a mirror for reflecting an X-ray beam from a synchrotron radiation source; a stage which holds a substrate to be exposed to the X-ray beam; and a measuring device disposed in proximity of the mirror, for measuring the intensity distribution of the X-ray beam irradiating the substrate, the measuring device comprising: a first detector for measuring an intensity such that a sheet-shaped beam of synchrotron radiation is integrated over the entire range of the beam in the thickness direction thereof; a second detector for measuring the intensity of the beam at two points where positions along the thickness direction are different; and calculating means for calculating the magnitude of the beam in the thickness direction on the basis of the detections by the first and second detectors.

According to a fourth aspect of the present invention, there is provided a semiconductor device manufacturing method comprising: generating an X-ray beam from a synchrotron radiation source; reflecting the X-ray beam by a mirror to irradiate a substrate with the X-ray beam; measuring in proximity to the mirror, intensity distribution of the X-ray beam irradiating the substrate, the measuring step comprising: measuring an intensity such that a sheet-shaped beam of synchrotron radiation is integrated over the entire range of the beam in the thickness direction thereof; measuring the intensity of the beam at two points where positions along the thickness direction are different; and calculating the magnitude of the beam in the thickness direction on the basis of the respective measurements; and exposing the substrate to the X-ray beam so as to transfer patterns of a semiconductor device.

The above and further objects, aspects and novel features of the invention will become more apparent from the following detailed description when read in conjunction with the accompanying drawings.

DETAILED DESCRIPTION OF THE PREFERRED EMBODIMENTS

Before describing the preferred embodiments of the present invention, the basic concept will be described. The present invention provides means or steps for moving two points at which the intensity of a sheet synchrotron beam is measured in the thickness direction of the beam. However, it is not necessary to move the two points at an actual measurement time. The measurement of the total intensity of a beam is performed by a radiation detector having a photo-receiving surface capable of receiving the beam in the thickness direction of the beam over the entire range of the beam at one time. Alternatively, the measurement of the total intensity of the beam is performed by detecting the accumulated synchrotron current value. It is also possible to perform a measurement of the total intensity with respect to a beam extracted from a beam line different from the beam line from which the beam whose intensity is measured at two points is extracted. The spacing between the two points is preferably not more than 1.5 times or not less than 2.5 times the size of the beam in the thickness direction, for example, the above-mentioned $\sigma$.

The total intensity is measured in advance in a plurality of conditions in which the accumulated current values are different, measurements are performed for the intensities at two points while the measurement points are moved in the thickness direction, and a correction function is determined in advance on the basis of these measured results. Thus, when actual measurements are to be performed, by using this correction function, it is possible to calculate the position or the size of the beam in the thickness direction on the basis of the measured values of the total intensity and the intensities at two points.

The ability to determine the size and the position of the beam in this manner depends on the following principles. If it is assumed that the intensity distribution of the beam follows a Gaussian distribution, the intensity distribution of the beam is determined uniquely if the center position Y0 of the beam, the spread $\sigma$ of the beam, and the total intensity I0 such that the beam is integrated in the Y direction which is the thickness direction of the beam are determined. Also, if the total intensity I0 such that the beam is integrated in the Y direction of the beam and the intensities at two specific points within the beam are determined, the intensity distribution of the beam is determined uniquely, and furthermore, the center position Y0 of the beam and the spread σ of the beam are also determined.

Figure 9:
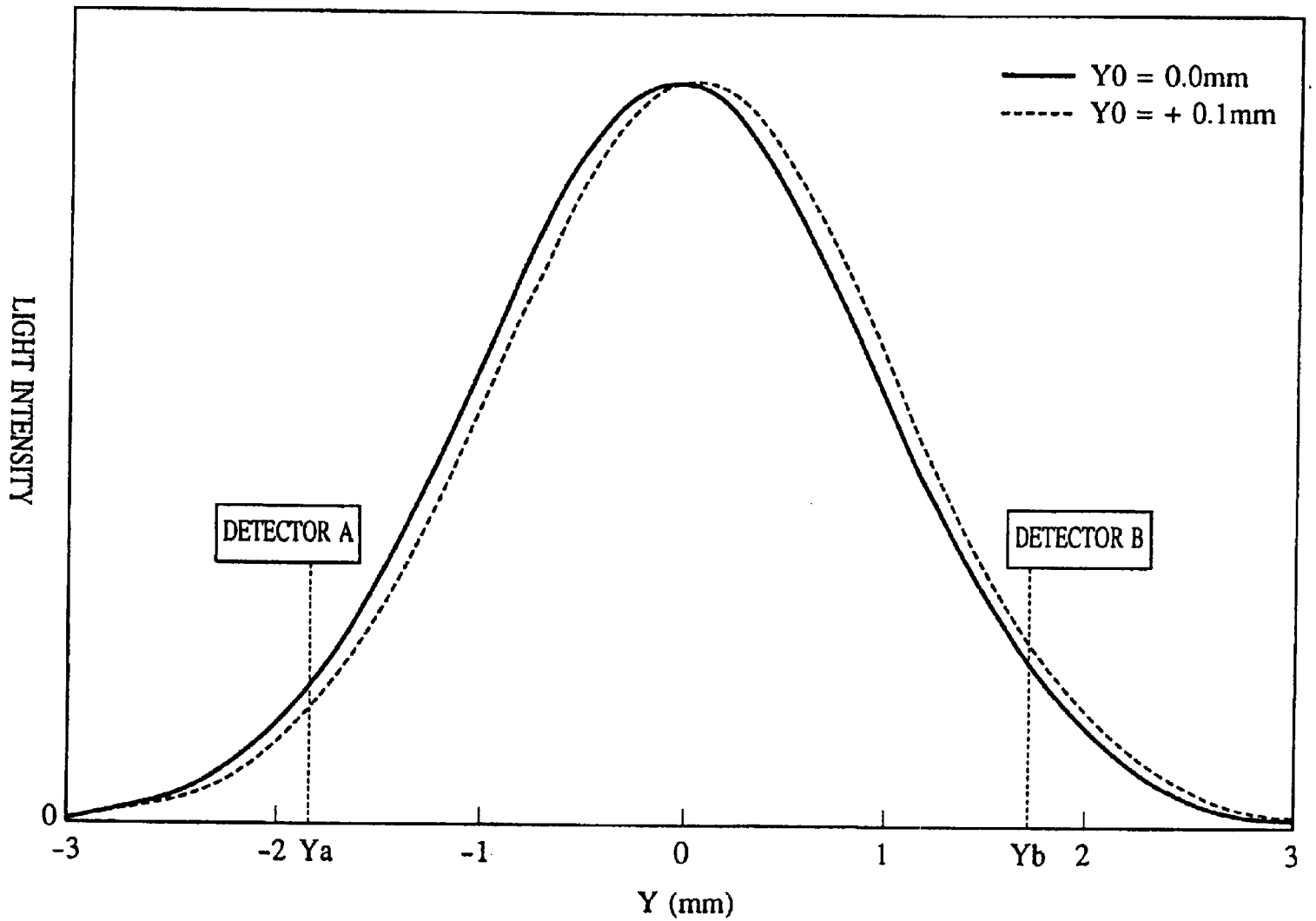
FIG. 9 is a graph showing measurement principles of the synchrotron radiation measurement apparatus according to the present invention.

These principles are described with reference to FIGS. 9 and 10. FIG. 9 shows the relationships among the beam profile when the total intensity is constant and the position (Y0) of the beam is varied and the positions of two detectors A and B. As shown in FIG. 9, in a case in which the two detectors A and B are disposed at positions Ya and Yb, which are symmetrical with respect to the beam at a predetermined spacing, if the beam is moved to the side of the detector A, the output of detector A is increased and the output of detector B is decreased. Conversely, if the beam is moved to the side of the detector B as indicated by the broken line, the output of the detector A is decreased and the output of the detector B is increased. In this case, the ratio of the output of the detector A to the output of the detector B is a parameter showing the position of the beam.

Also, the larger the spacing between the detectors A and B, the more sharply the ratio of the output of the detector A to the output of the detector B varies with respect to the positional variation of the beam. Therefore, the sensitivity of beam position detection increases as the spacing between the two detectors A and B increases.

Figure 10:
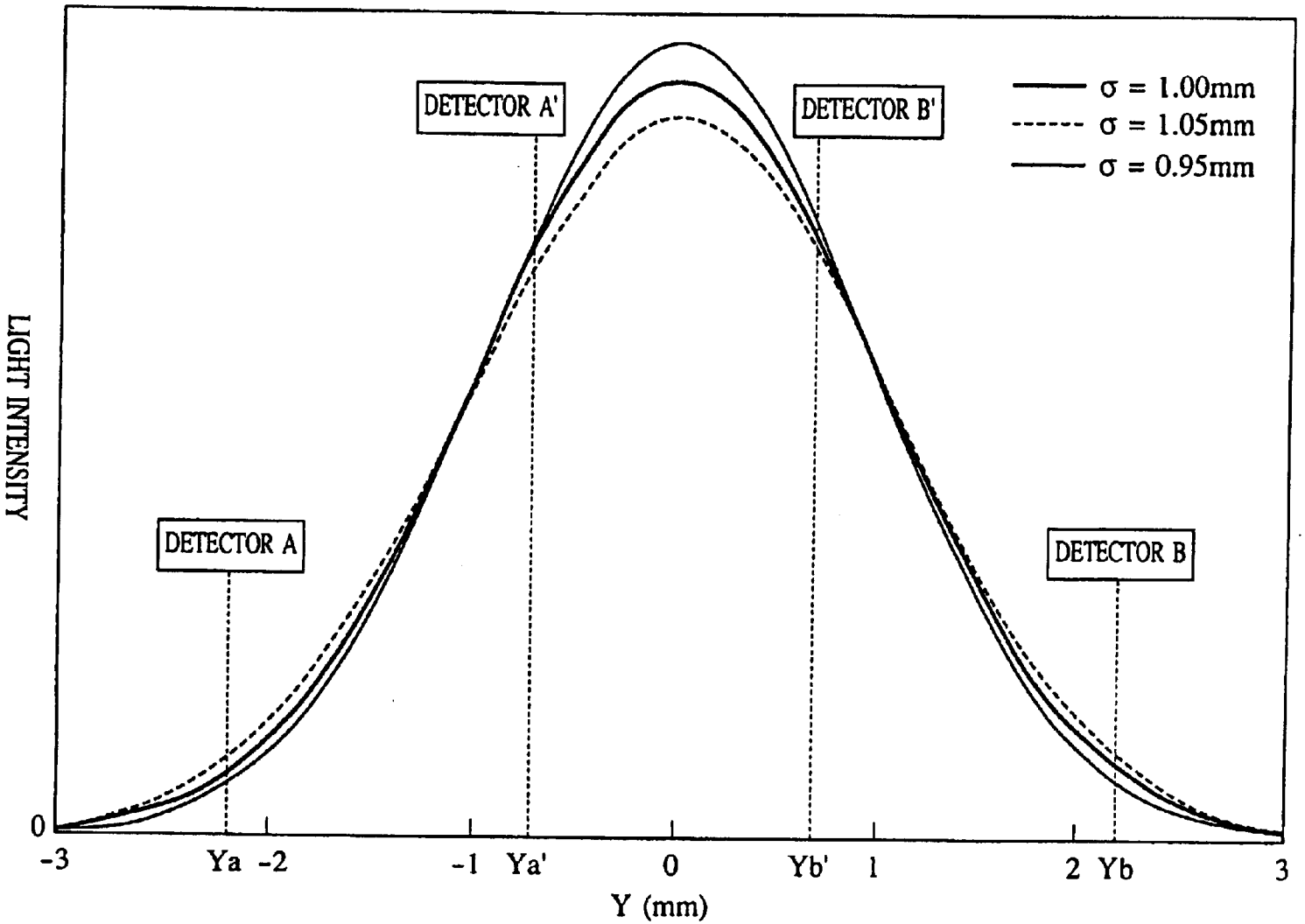
FIG. 10 is another graph showing measurement principles of the synchrotron radiation measurement apparatus according to the present invention.

FIG. 10 shows a variation of a beam profile when the total intensity is constant and the spread (σ) of the beam is varied. As shown in FIG. 10, in a case in which the two. detectors A and B are disposed symmetrically with respect to the beam at a spacing larger than twice the σ of the beam, if the σ of the beam is increased as indicated by the broken line, both of the outputs of the detectors A and B are increased. Conversely, if the σ of the beam is decreased, both of the outputs of the detectors A and B are decreased. On the other hand, in a case in which detectors A' and B' are disposed at positions Ya' and Yb' symmetrical with respect to the beam at a spacing smaller than twice the σ of the beam, if the σ of the beam is increased, both of the outputs of the detectors A and B are decreased. Conversely, if the σ of the beam is decreased, both of the outputs of the detectors A' and B' are increased. In the same manner as described above, the sum of the respective outputs of detectors A and B becomes a parameter indicating the spread of the beam.

However, even when the σ of the beam is constant and the intensity of the entire beam is varied, the sum of the outputs of the detectors A and B is varied. That is, even if the sum of the outputs of the detectors A and B varies, no distinction can be made as to whether this is due to the fact that the intensity of the entire beam was varied or whether the σ of the beam was varied. Therefore, the intensity of the entire beam is measured by another means, and the outputs of the detectors A and B are normalized using this value. The sum of the outputs of the detectors A and B which are normalized in this manner allows the spread of the beam to be determined. The method for measuring the intensity of the entire beam is described in detail in the embodiment.

Also, in a case in which the two detectors A and B are disposed symmetrically with respect to the beam at a spacing twice the σ of the beam, even if the σ of the beam is varied, the outputs of the detectors A and B do not vary. Therefore, it is not possible to measure the a of the beam when the spacing between the detectors A and B is twice the σ. In order to measure the σ of the beam, it is necessary for the spacing of the detectors to avoid a value close to the σ of the beam. In order to accurately measure the σ of the beam, it is preferable that the spacing of the detectors be not more than 1.5 times the σ of the beam or not less than 2.5 times the σ of the beam.

When the spacing between the detectors A and B is Increased, the variation increases in the output of the detector when the beam position is varied. That is, when the spacing between the detectors A and B is increased, the sensitivity of beam position detection is improved. Therefore, in order to accurately measure the σ of the beam and the position Y thereof at the same time, preferably, the spacing between the two detectors is larger than two times the σ of the beam, and more preferably, the spacing between the two detectors is larger than 2.5 times the σ.

Based on these principles, in the present invention, as preparations for measuring the size and the position of the beam, the total intensity of the beam and the intensities at two points are measured while Y scanning is performed under conditions in which the sizes of the beam are different (conditions in which, for example, the accumulated current values are different), and the ratio of these measured values is calculated as a function of Y and σ. Specific correction means is described in detail in the embodiment. After the correction is completed, adjustments are made so that the beam enters at approximately the midpoint of the two measurement points, the total intensity I0 and intensities IA and IB at two points are measured, and the value of this ratio is substituted in the correction function determined by the previous correction in order to calculate the thickness σ and the position Y of the beam. This calculation can be performed in a very short time by converting the output of a measurement means into a numerical value by using an analog-digital converter and by processing the information with a computer.

First Embodiment

Figure 1:
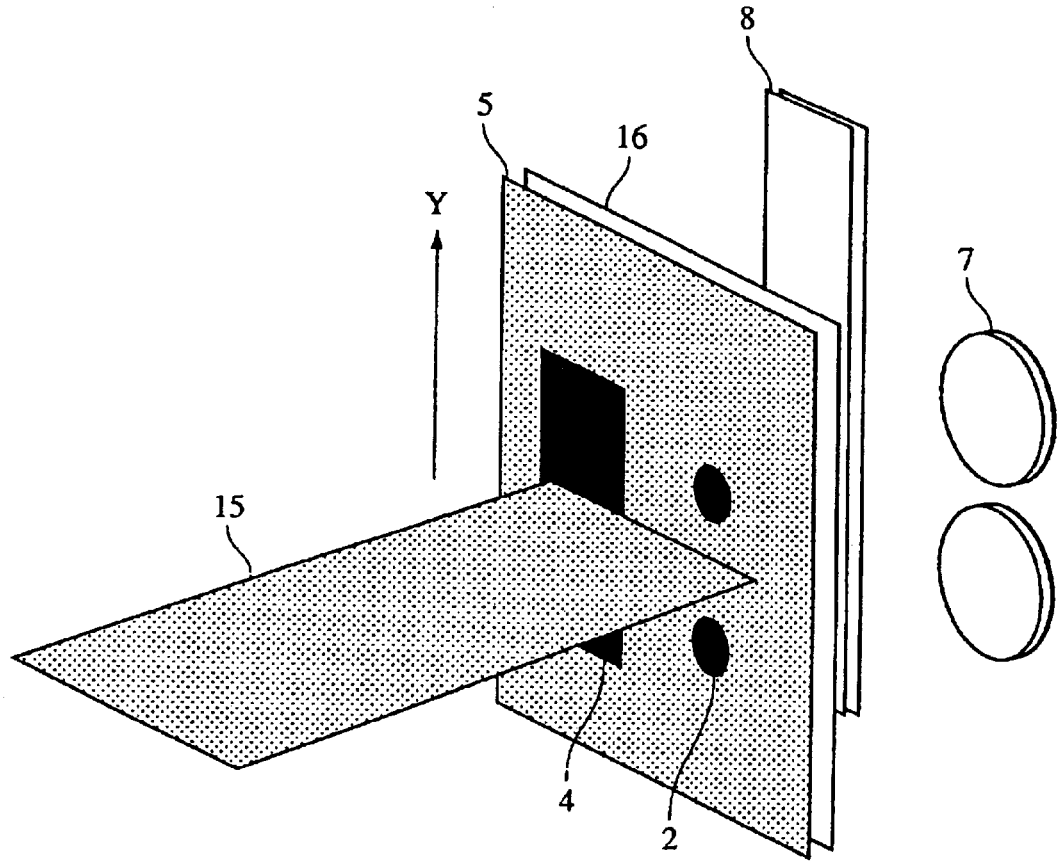
FIG. 1 is a perspective view showing a main portion of a synchrotron radiation measurement apparatus according to a first embodiment of the present invention.
Figure 2:
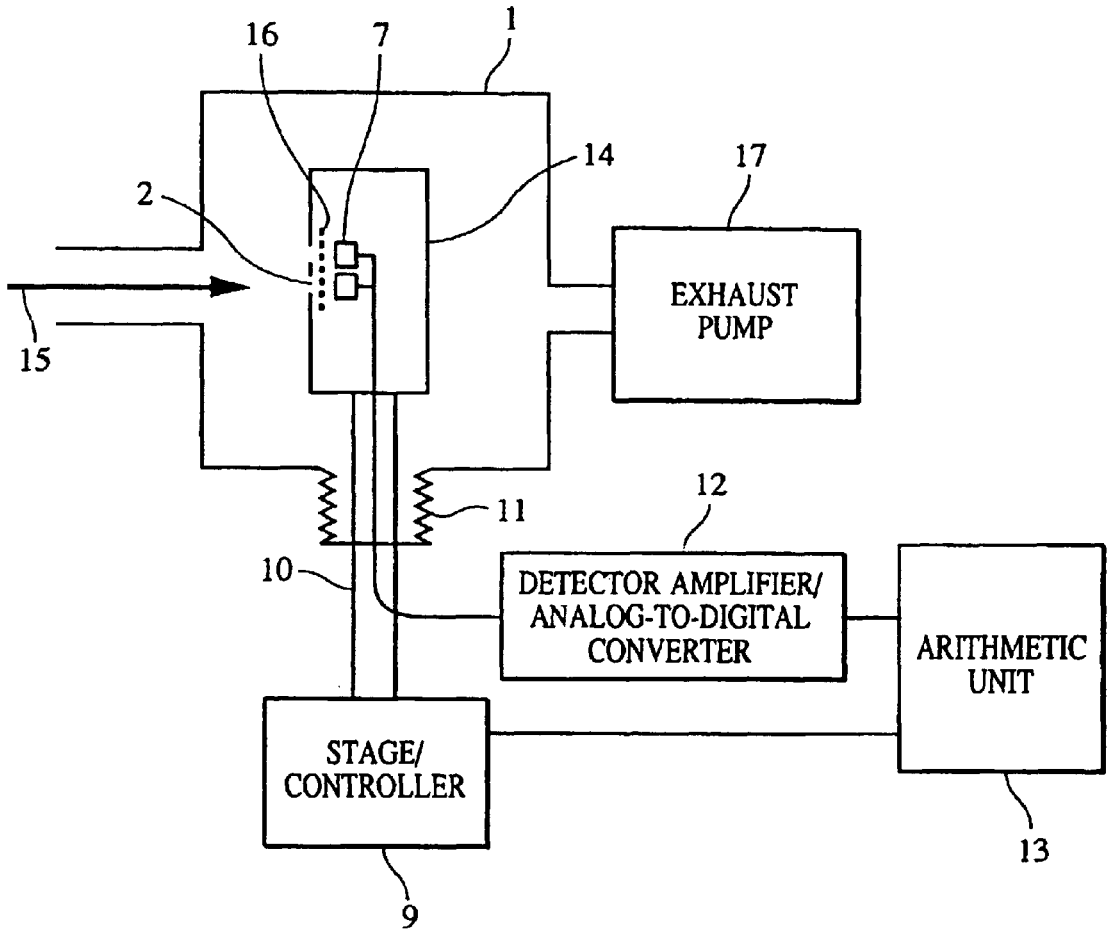
FIG. 2 is a block diagram of the synchrotron radiation measurement apparatus according to the first embodiment of the present invention.

FIG. 2 is a block diagram showing the construction of a synchrotron radiation measurement apparatus according to a first embodiment of the present invention. FIG. 1 is a perspective view showing a main portion of the synchrotron radiation measurement apparatus. This apparatus measures the position and the size of a beam by synchrotron radiation by using three photodiodes. As shown in these figures, this apparatus comprises a vacuum container 1 to which a beam 15 by synchrotron radiation is introduced; an aperture plate 5. disposed inside the vacuum container 1, which is provided with two pin holes 2 and one longitudinal slit 4 which is elongated in the Y direction; an X-ray detector, disposed behind this aperture plate 5, which has three photodiodes 7 and 8; a stage/controller 9 for driving this X-ray detector in the Y direction; a rod 10, and a bellows mechanism 11 for mechanically connecting the stage/controller 9 in the air with an X-ray detector in a vacuum by the vacuum container 1 and for maintaining the vacuum; and a detector amplifier/analog-to-digital converter 12 and a calculating unit 13 for inputting the output of the X-ray detector and the amount of stage driving of the stage/controller 9 and for recording this information.

The X-ray detector is housed in a shield case 14 made of a metal so that the photodiodes 7 and 8 are prevented from being irradiated by extraneous visible light and photoelectrons. Furthermore, the shield case 14 is placed in the vacuum container 1, and the vacuum container 1 is evacuated to an ultra-high vacuum by an evacuation pump 17. The vacuum container 1 is connected to a synchrotron ring via a gate valve. The aperture plate 5 is provided on the most upstream side of the shield case 14. Also, the aperture plate 5 is made of a copper plate and is cooled by water in order to moderate a temperature increase due to the thermal load of the synchrotron radiation. The diameter of each of pin holes 2 provided in the aperture plate 5 is 0.5 mm, and the Y-direction spacing between the two pin holes 2 is 8 mm. The width of the longitudinal slit 4 is 1 mm, and the length thereof in the Y direction is 20 mm. The spread a of the synchrotron radiation beam 15 to be measured is approximately 2 mm, and the length of the longitudinal slit 4 has a sufficient size with respect to the spread σ of the beam. Also, the Y-direction spacing of the pin holes 2 is set to be approximately four times as large as σ. The shape of the opening of the pin hole 2 may not be circular, and for example, may be rectangular. Also, there is no need for each opening of the pin hole 2 and the longitudinal slit 4 to be provided in a single metallic plate, and three aperture plates having one opening may be combined.

On the downstream side of the aperture plate 5, for the purpose of preventing damage by radiation and for blocking visible light contained in the SR beam 15, a filter 16 made of a metallic foil, for example, an aluminum foil having a thickness of several hundreds of μm, is provided. Two photodiodes 7 and one photodiode 8 are provided, downstream of the filter 16, at positions corresponding to the two pin holes 2 and one longitudinal slit 4, respectively. The photodiode 7, provided downstream of the pin hole 2, has a circular photo-receiving surface having a diameter of 5 mm, and the photodiode 8, provided downstream of the longitudinal slit 4, has a rectangular photo-receiving surface of a width having 5 mm and a length of 25 mm, so that the light passing through each aperture of the pin hole 2 and the longitudinal slit 4 enters the photo-receiving surfaces of the photodiodes 7 and 8, respectively.

The stage/controller 9 has a Y stage provided outside the vacuum container 1. This Y stage is connected by the rod 10 to the shield case 14 inside the vacuum container 1. The bellows 11 is connected at one end to the rod 10 and is welded at the other end to the chamber 1. This makes it possible for the rod 10 to be driven in the Y direction while maintaining a vacuum.

The correction procedure is described below. During correction, it is necessary to measure the output values of the three photodiodes 7 and 8 while performing Y scanning by the Y stage on different beam sizes. Although the beam size cannot be determined beforehand, measurements may be performed by varying another parameter which affects the beam size. For example, the beam size may vary in a manner dependent on the accumulated current value. Therefore, the output values of the three detectors need only be measured while performing Y scanning at different current values.

At a particular current value, the outputs of the photodiodes 7 associated with the pin hole 2 are denoted as S1 and S2, and the output of the photodiode 8 for measuring the total intensity associated with the longitudinal slit 4 is denoted as S0. Then, element output ratios R1 and R2 are calculated as a function of Y while Y scanning is performed. Here, R1 and R2 are expressed by the following equations:

$$R1=(SA-SB)/(SA+SB)$$

$$R2=(SA+SB)/S0$$

Next, fitting is performed by Gaussian with the outputs S1 and S2 of the two detectors as a function of Y in order to determine the thickness σ of the beam in the Y direction. Based on the above data processing, R1 and R2 are determined as functions of σ and Y.

Y scanning is repeated under conditions in which the current values are different, a table of σ, Y, R1, and R2 is stored, and the correction function is determined. For example, scanning is performed at 10 points for every 100 mA from when the accumulated beam current value is 100 mA. In this embodiment, σ and Y are fitted as polynomial equations for R1 and R2. For example, substitution is performed as in the following equation in order to determine each coefficient so that the sum of the squares of the differences with the actually measured σ and Y becomes a minimum.

$$\sigma=Cs30R1\hat{}3+Cs03R2\hat{}3+Cs21R1\hat{}2R2+Cs12R1R2\hat{}2+Cs11R1R2+Cs20R2\hat{}1+Cs02R2\hat{}2+Cs10R1+Cs10R2+Cs00$$

$$Y=Cy30R1\hat{}3+Cy03R2\hat{}3+Cy21R1\hat{}2R2+Cy12R1R2\hat{}2+Cy11R1R2+Cy20R1\hat{}2+Cy02R2\hat{}2+Cy10R1+Cy01R2+Cy00$$

Since R1 may be a parameter which reflects the ratio of the output S1 to that of S2, correction may similarly be performed by using, for example, a logarithm of the ratio of S1 to S2, R1=log(S1/S2), the ratio of the difference between S1 and S2 to S0, R1=(S1−S2)/S0, and by other means.

When the sensitivities of two detectors are different, normalization is performed so that the peak outputs become equal by multiplication by a coefficient. That is, when the maximum value of the output S1 is S1max and the maximum value of the output S2 is S2max, correction may be performed by determining R1 and R2 as detector outputs such that S1/S1max and S2/S2max are each normalized. After the correction is completed, the Y stage is fixed so that the beam enters at nearly the midpoint of the two pin holes 2, and the outputs of the three photodiodes 7 and 8 ate measured. R1 and R2 are calculated by the following equations from the measured values of SA, SB, and S0.

$$R1=(SA-SB)/(SA+SB)$$

$$R2=(SA+SB)/S0$$

Then, these are substituted in the following correction function which is determined by the previous correction, and the thickness σ and the position Y of the beam are calculated.

$$\sigma=Cs30R1\hat{}3+Cs03R2\hat{}3+Cs21R1\hat{}2R2+Cs12R1R2\hat{}3+Cs11R1R2+Cs20R1\hat{}2+Cs02R2\hat{}2+Cs10R1+Cs10R2+Cs00$$

$$Y=Cy30R1\hat{}3+Cy03R2\hat{}3+Cy21R1\hat{}2R2+Cy12R1R2\hat{}2+Cy11R1R2+Cy20R1\hat{}2+Cy02R2\hat{}2+Cy10R1+Cy01R2+Cy00$$

When, however, correction is performed by using R1=log(S1/S2), R1=(S1−S2)/S0, etc., as R1, these parameters are substituted in the function obtained by correction.

These calculations can be performed in a very short time by converting the outputs of the photodiodes 7 and 8 into numerical values by using the analog-to-digital converter 12 and by processing the data in a computer 13.

According to this measurement method, stage driving is not required during measurement, and the position and the spread of the beam can be determined immediately by calculating the output of a photodiode at a particular time. For this reason, variations over a short time can also be accurately measured. Also, since there is no need to drive the Y stage during measurement, no adverse influence, such as vibration, is exerted on other apparatuses. Furthermore, the power consumption is low, and the service life of the apparatus is long.

Second Embodiment

Figure 3:
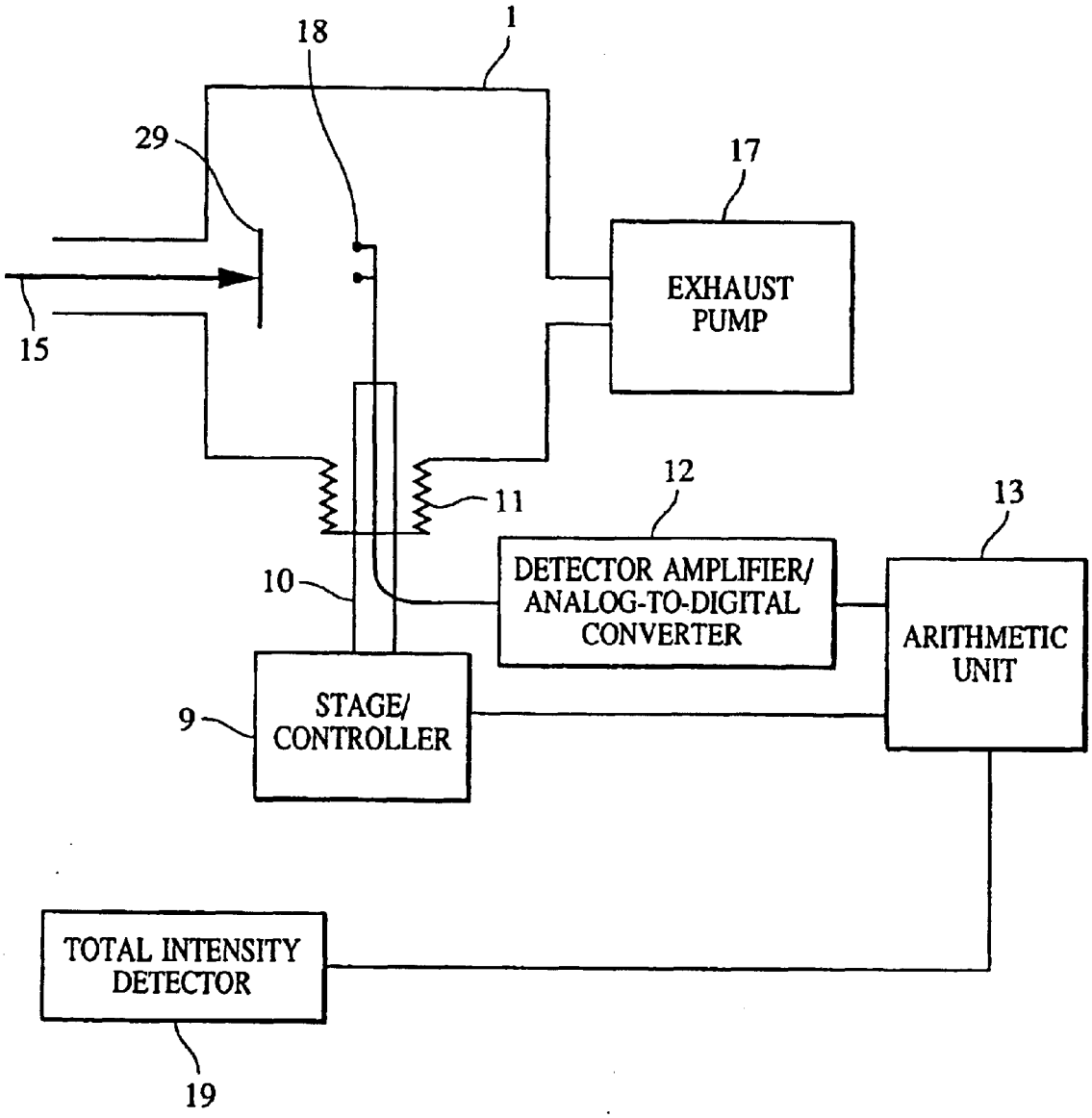
FIG. 3 is a block diagram showing the construction of a synchrotron radiation measurement apparatus according to a second embodiment of the present invention.
Figure 4:
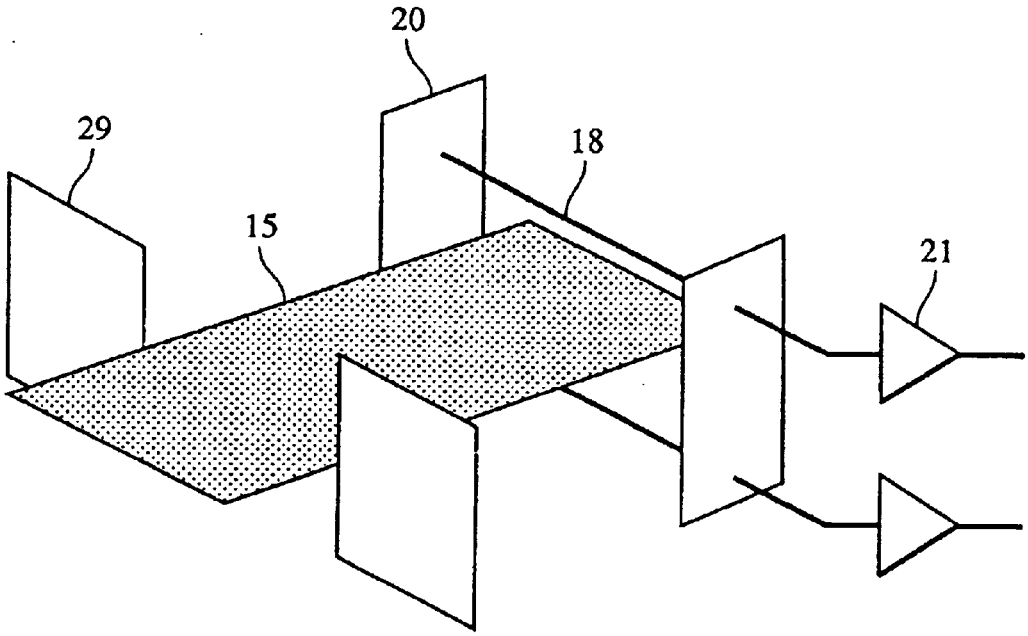
FIG. 4 is a perspective view showing a main portion of the apparatus of FIG. 3.

FIG. 3 is a block diagram showing the construction of a synchrotron radiation measurement apparatus according to a second embodiment of the present invention. FIG. 4 is a perspective view showing a main portion of the synchrotron radiation measurement apparatus. This apparatus measures the position and the size of a beam of synchrotron radiation by using two wires and a total intensity monitor for another beam line. In these figures, reference numeral 18 denotes a metal wire (a total of two) which is a constituent of a detector of synchrotron radiation 15. Reference numeral 9 denotes a stage/controller for driving the metal wire 18 in the Y direction. Reference numeral 19 denotes a total Intensity detector provided in the other beam line. Reference numeral 13 denotes a calculating unit for receiving the output of an X-ray detector and the amount of driving of a stage and for storing the data. The other reference numerals which are the same as those of FIGS. 1 and 2 indicate the same elements as those in FIGS. 1 and 2.

The metal wire 18 is placed in a vacuum container 1, and the vacuum container 1 is evacuated to an ultra-high vacuum by an evacuation pump 17. The vacuum container 1 is also connected to a synchrotron ring via a gate valve. The two wires 18 are maintained in parallel with the plane of the beam 15 by an insulator 20, such as a ceramic. The insulator 20 is mechanically coupled to a Y stage of the stage/controller 9 outside the vacuum container 1, and is driven in the Y direction. For the wire 18, a tungsten wire, etc., plated with gold, is used. The thickness thereof is, for example, approximately 0.1 to 1 mm. The wire 18 is connected to a bias application circuit of a bias application circuit/current-to-voltage conversion circuit 21 outside the vacuum container 1, so that a voltage of several volts to several hundreds of volts is applied to the vacuum container 1. At this time, when the synchrotron radiation beam 15 is irradiated onto the wire 18, photoelectrons are generated, and since these photoelectrons are moved by an electric field by the applied voltage, electric current is made to flow through the wire 18. In order to detect this electric current, the wire 18 is also connected to a current-to-voltage conversion circuit of the bias application circuit/current-to-voltage conversion circuit 21. The output of the current-to-voltage conversion circuit is made to pass through an analog-to-digital conversion circuit of the detector amplifier/analog-to-digital converter 12 and is input to the calculating unit 13.

In this embodiment, a total intensity detector is not provided for the beam line 15 for which measurements are performed, and instead, the output of the total intensity detector 19 provided for another beam line is used. The position and the size of the beam 15 can be measured in a manner similar to the case of the first embodiment.

In general, in a synchrotron radiation source, there are cases in which a large number of beam lines are provided, and the positions and the sizes of the beams are measured for a large number of beam lines. In such cases, when the apparatus of this embodiment is used, two detectors are provided for each beam line, and furthermore, a detector for measuring the total intensity is provided for only one beam line. According to this method, it is possible to minimize the number of detectors and to reduce the number of signal processing devices correspondingly. Therefore, it is possible to reduce the cost of the overall system.

Third Embodiment

Figure 5:
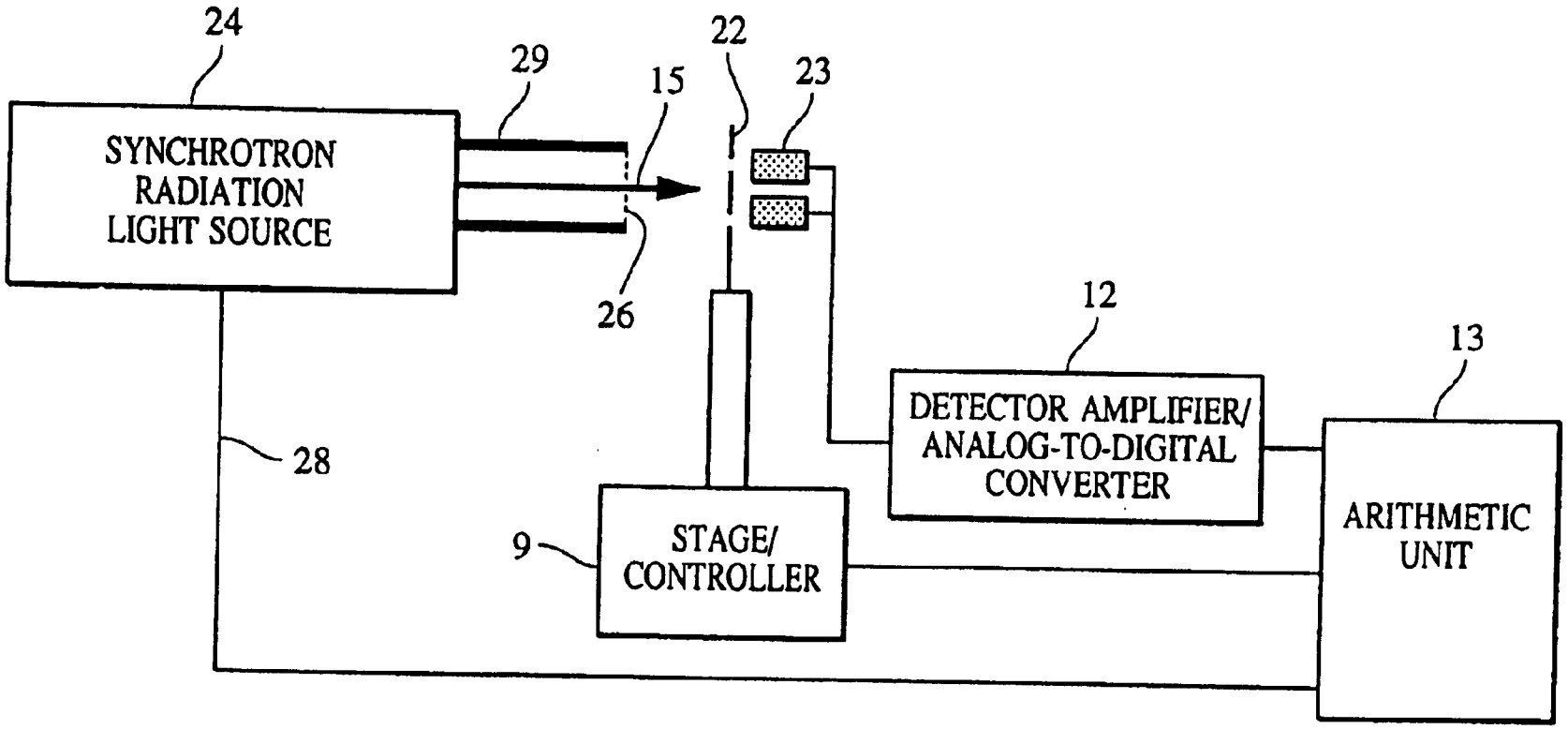
FIG. 5 is a block diagram showing the construction of a synchrotron radiation measurement apparatus according to a third embodiment of the present invention.
Figure 6:
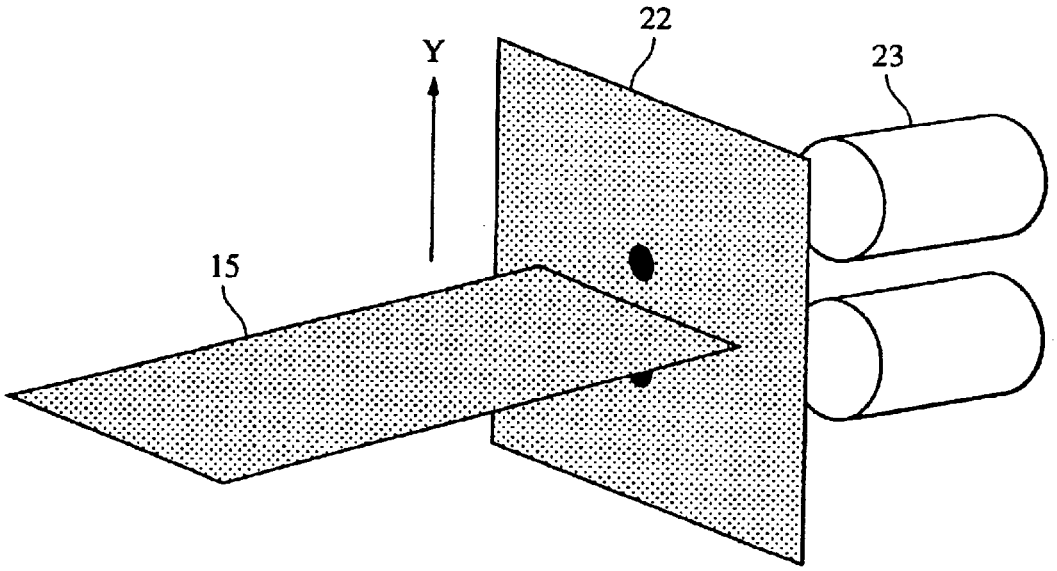
FIG. 6 is a perspective view showing a main portion of the apparatus of FIG. 5.

FIG. 5 is a block diagram showing the construction of a synchrotron radiation measurement apparatus according to a third embodiment of the present invention. FIG. 6 is a perspective view showing a main portion of the synchrotron radiation measurement apparatus. In this apparatus, in order to measure the position and the size of a synchrotron radiation beam, an ion chamber and a synchrotron accumulated current value are used. This apparatus comprises an aperture plate 22 provided with two pin holes, two ion chambers 23 positioned at positions corresponding to these pin holes, a stage/controller 9 for driving the aperture plate 22 in the Y direction, means for measuring the accumulated current value of a synchrotron radiation source 24, a calculating unit 13 for receiving the output of the ion chamber 23, an accumulated current value 28 of the synchrotron radiation source 24, and the amount of driving of the stage of the stage/controller 9 and for storing the data.

This measurement apparatus performs measurements of synchrotron radiation in the air. The synchrotron radiation beam 15 which is passed through a beryllium window 26 and then passes through air is shielded by the aperture plate 22 provided with two pin holes, and the X-rays which have passed through the pin holes are measured by the two ion chambers 23. The aperture plate 22 is fixed to the Y stage of the stage/controller 9 and can be driven in the Y direction. The ion chamber 23 is not fixed to the Y stage, but is fixed to the floor surface. The photo-receiving surface of the ion chamber 23 is approximately 20 mm, and even if the aperture plate 22 is moved in the Y direction, the X-rays passing through the pin holes always enter the ion chamber 23.

The total intensity of the synchrotron radiation is proportional to the accumulated current value of an electron accumulation ring if the acceleration energy and the intensity of the magnetic field are fixed. In this embodiment, data 28 of the accumulated current value of the electron accumulated ring is used instead of the total intensity by the total intensity detector. The accumulated current value can normally be measured with high accuracy by a current transformer, such as a DCCT.

In general, in a synchrotron radiation source, there are cases in which a large number of beam lines are provided, and the positions and the sizes of the beams are measured for a large number of beam lines. In such a case, when the apparatus of this embodiment is used, two detectors are provided for each beam line, and the information of the beam current measured by a current transformer is used in common among a large number of measurement apparatuses, the number of detectors can be minimized, making it possible to reduce the number of signal processing apparatuses correspondingly. Therefore, it is possible to reduce the cost of the overall system. Also, in this embodiment, since the measurement apparatus is in the air, and a vacuum container, an evacuation pump, etc., are not required, the cost of the apparatus can be reduced. Furthermore, in this embodiment, a member driven by a Y stage is only the aperture plate 22 and is of a light weight, and a small stage can be used. Therefore, the cost of the apparatus can be reduced further.

Fourth Embodiment

Figure 7:
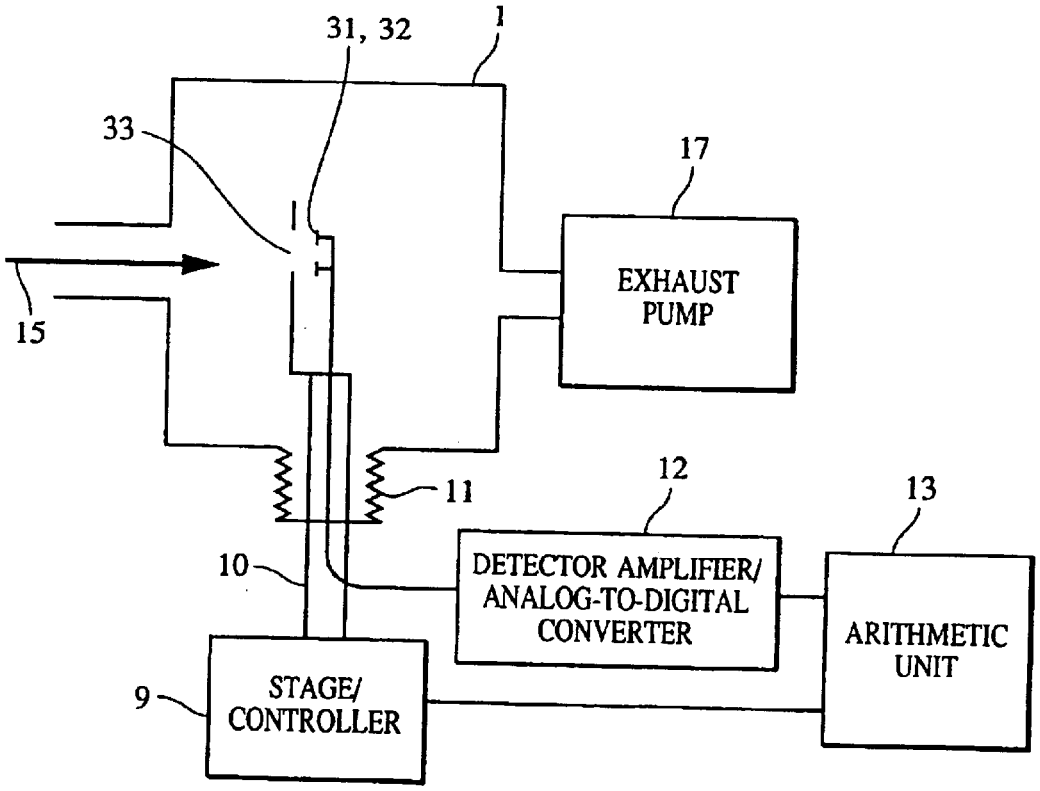
FIG. 7 is a block diagram showing the construction of a synchrotron radiation measurement apparatus according to a fourth embodiment of the present invention.
Figure 8:
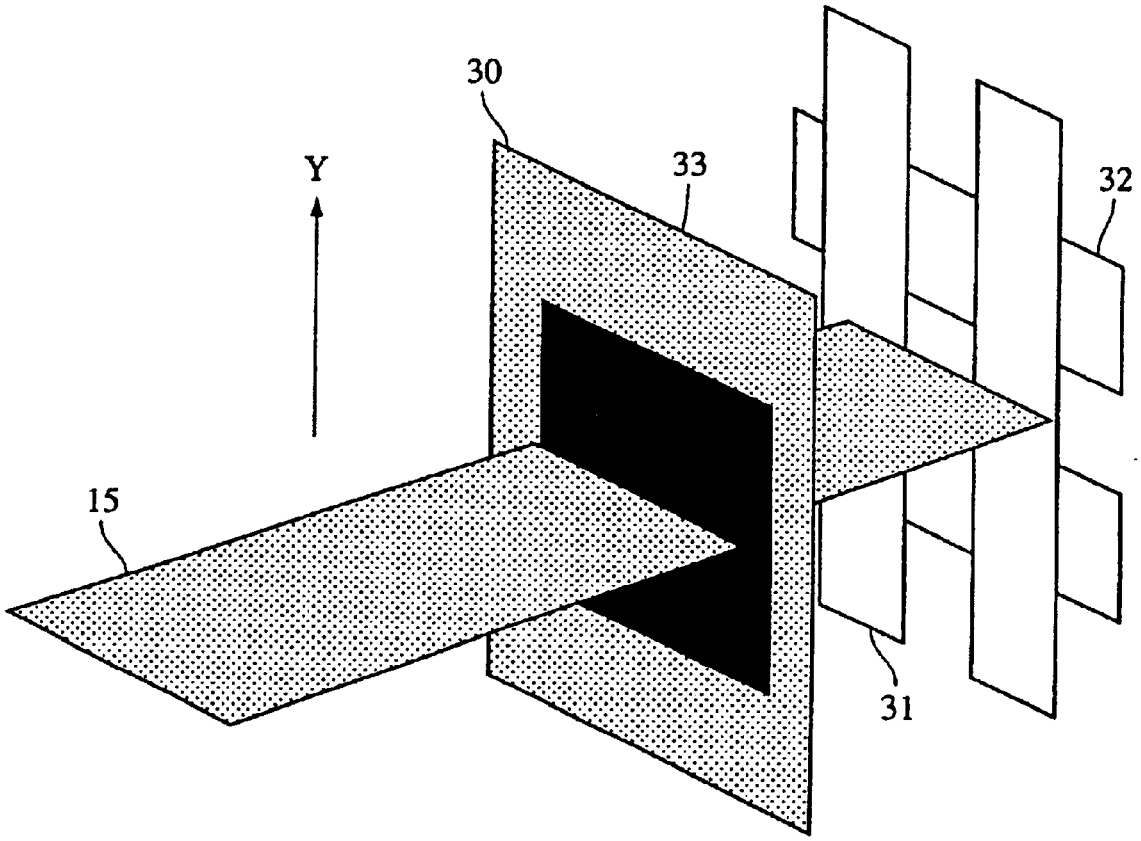
FIG. 8 is a perspective view showing a main portion of the apparatus of FIG. 7.

FIG. 7 is a block diagram showing the construction of a synchrotron radiation measurement apparatus according to a fourth embodiment of the present invention. FIG. 8 is a perspective view showing a main portion of the synchrotron radiation measurement apparatus. In this apparatus, in order to measure the position and the size of a synchrotron radiation beam, photoelectric effects on four metal plates are used. This apparatus comprises an aperture plate 30 in which a rectangular hole is provided, two metal plates 31 disposed at corresponding positions behind this aperture plate 30, for regulating the range of the synchrotron radiation 15 in the Y direction, which radiation has passed through the aperture plate 30, two metal plates 32 for similarly regulating the range of the synchrotron radiation 15 in the Y direction, a stage/controller 9 for driving the aperture plate 30 and the metal plates 31 and 32 in the Y direction, and a calculating unit 13 for receiving the photoelectric values of the metal plates 31 and 32 and the amount of driving of the stage of the stage/controller 9 and for recording the data.

In this embodiment, the synchrotron radiation 15 is irradiated onto a plurality of metal plates 31 and 32, and photoelectrons therefrom are measured. The entire measurement apparatus is housed in the vacuum container 1. The aperture plate 30 is provided most upstream, so that the width of the synchrotron radiation beam 15 in the X direction is controlled. The width of an aperture 33 of the aperture plate 30 in the Y direction is sufficiently larger than the width of the beam, and therefore, the width of the synchrotron radiation beam 15 in the Y direction is not controlled. Behind the aperture 33, two metal plates 31 for regulating the synchrotron radiation beam 15 in the X direction are provided, and furthermore, two metal plates 32 for regulating the synchrotron radiation beam 15 in the Y direction are provided downstream thereof.

Since the entire beam 15 in the Y direction is irradiated onto the metal plate 31, photoelectric current therefrom is proportional to the total intensity of the beam 15. Therefore, the metal plate 31 can be used as a total intensity detector. A part of the beam 15 in the Y direction is irradiated onto the metal plate 32. Therefore, photoelectric current from the metal plate 32 can be used as the output of the two detectors located at Y-different positions.

According to this embodiment, since the central portion of the beam 15 is not shielded by a detector and is passed through as is, it can be used for other measurements, material processing, and the like.

As has thus been described, since the size of a beam in the thickness direction and the position thereof are calculated based on the total intensity of the beam and the intensities at two points, it is possible to determine the size and the position of the beam in a very short time. Therefore, it is possible to accurately measure variations in a short time, which cannot be so determined in conventional technology. Also, it is possible to eliminate the need to drive the stage during measurement, except for the case of correction. For this reason, power consumption can be reduced, and the cost of maintenance can be minimized. Furthermore, since there is no need to drive a stage during measurement except for the case of correction, exertion of adverse influences, such as vibrations, on other apparatuses which use synchrotron radiation can be prevented. In addition, since driving of the stage is limited to the time of correction, the wear on the apparatus, such as the bellows and stage mechanism, can be reduced, and the service life of the apparatus can be substantially extended.

Fifth Embodiment

Figure 11:
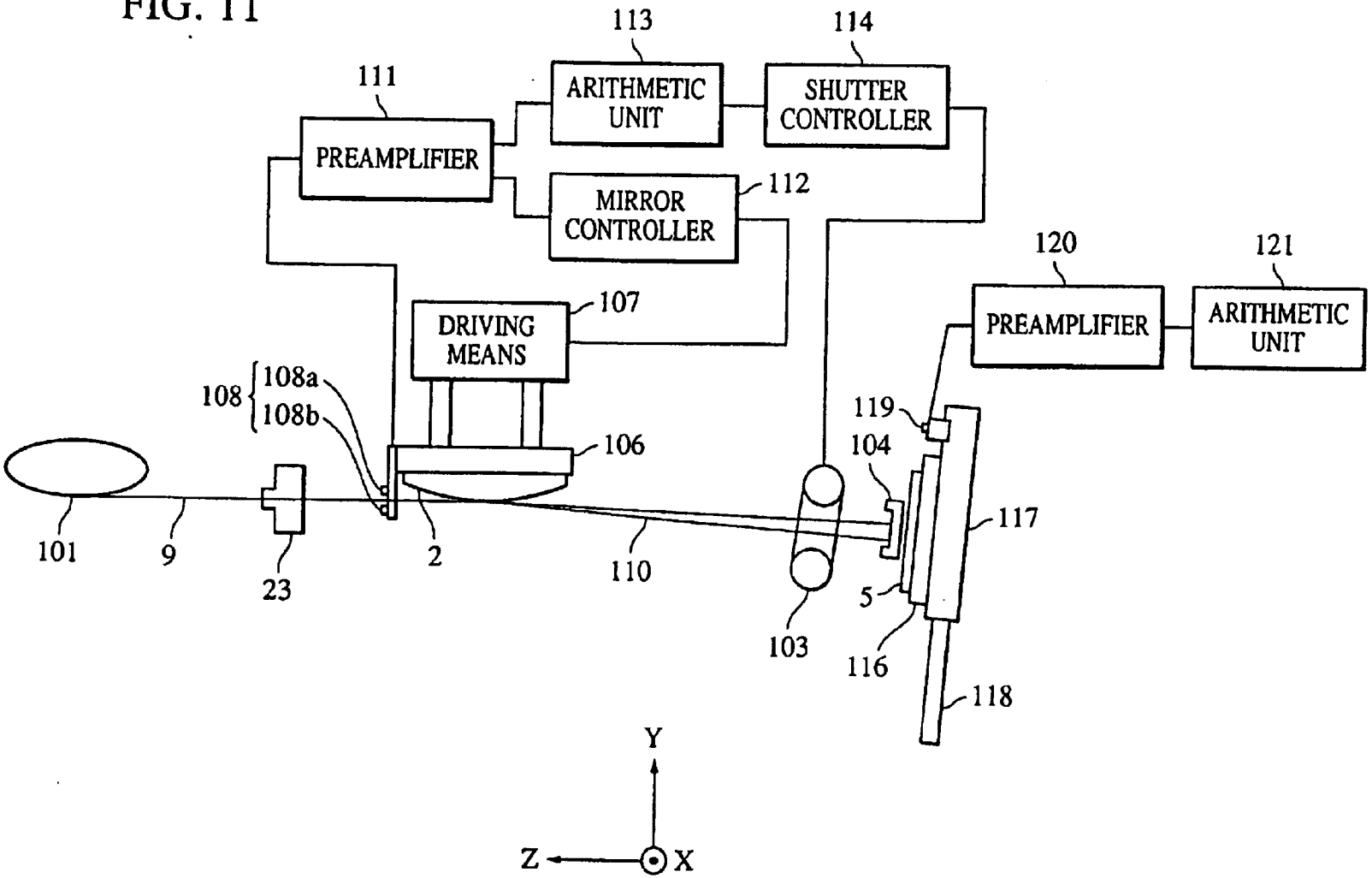
FIG. 11 is a schematic diagram of the construction of an X-ray exposure apparatus according to an embodiment of the present invention.

FIG. 11 is a diagram of the construction of an embodiment of an X-ray exposure apparatus, including the above-described synchrotron radiation measurement apparatus. Referring to FIG. 11, reference numeral 101 denotes a synchrotron ring which is a light source for emitting synchrotron radiation. Reference numeral 102 denotes a cylindrical mirror for reflecting a sheet-shaped beam 9 from the synchrotron ring 101 in order to form an expanded beam 10. Reference numeral 103 denotes a shutter for controlling the amount of exposure by the expanded beam 10. Reference numeral 104 denotes a mask having an exposure pattern. Reference numeral 105 denotes a wafer in which the pattern of the mask 104 is exposed. Reference numeral 106 denotes a mirror holder for holding the cylindrical mirror 102. Reference numeral 107 denotes a means for driving the mirror holder 106. Reference numeral 108*a* denotes a first X-ray detector which is mounted in the mirror holder 106. Reference numeral 108*b* denotes a second X-ray detector which is mounted in the mirror holder 106. Reference numeral 111 denotes a preamplifier for amplifying the outputs of the X-ray detectors 108*a* and 108*b*. Reference numeral 112 denotes a mirror controller for controlling the driving of the driving means 107 on the basis of the output of the preamplifier 111. Reference numeral 113 denotes a calculating unit for performing a predetermined calculation on the basis of the output of the preamplifier 111. Reference numeral 114 denotes a shutter controller for controlling the driving of the shutter 103 on the basis of the calculation result of the calculating unit 113. Reference numeral 116 denotes a wafer chuck for holding a wafer 105. Reference numeral 117 denotes a wafer stage for driving the wafer chuck 116. Reference numeral 118 denotes a means for driving the wafer stage 117. Reference numeral 119 denotes an X-ray detector mounted in the wafer stage 117. Reference numeral 120 denotes a preamplifier for amplifying the output of the X-ray detector 119. Reference numeral 121 denotes a calculating unit for performing a predetermined calculation on the basis of the output of the preamplifier 120. Reference numeral 123 denotes a beam monitor for measuring the intensity of the sheet-shaped beam 9 and the intensity distribution. The beam monitor 123 has the construction described above with reference to one of FIGS. 7 and 8.

In this construction, the sheet-shaped beam 9 emitted from the synchrotron ring 101 is expanded in the Y direction by the cylindrical mirror 102, and an exposure angle of view on the mask 104 is secured. Since this expanded beam 10 has an intensity distribution in the Y direction, in order that a uniform amount of exposure can be obtained on the mask 104 and wafer 105 by canceling the intensity distribution in the Y direction by the exposure time, the shutter controller 114 controls the driving of the shutter 103 so as to adjust the movement speed of the shutter 103 according to the intensity distribution.

For the positional relationship between the cylindrical mirror 102 and the sheet-shaped beam 9, the positions of both of them must be made to coincide with each other with high accuracy, and the cylindrical mirror 102 must be made to follow the sheet-shaped beam 9 in the Y direction according to the vibrations and the deviation of the sheet-shaped beam 9. Therefore, the cylindrical mirror 102 is disposed in the mirror holder 106 so that it can be driven in the Y direction by the driving means 107. The first and second X-ray detectors 108*a* and 108*b* mounted in the mirror holder 106 sense beams within a predetermined area in proximity to the upper edge and the lower edge of the sheet-shaped beam 9, respectively.

The outputs of the first and second X-ray detectors 108*a* and 108*b* are amplified by the preamplifier 111, and the amplified outputs Va and Vb are sent to the preamplifier 111 and the calculating unit 113. The mirror controller 112 compares the amplified outputs Va and Vb of the two X-ray detectors 108*a* and 108*b* with each other, and causes the driving means 107 to move the cylindrical mirror 102 so as to control the position thereof on the basis of the comparison result so that the two outputs Va and Vb become equal to each other, thereby causing the sheet-shaped beam 9 and the cylindrical mirror 102 to coincide with each other with high accuracy.

Also, the intensity of the synchrotron radiation which enters the mirror 102 and the intensity distribution are measured instantaneously by the beam monitor 123, and the spread of the intensity distribution is determined. The "spread" referred to herein refers to a standard deviation when the intensity distribution of the synchrotron radiation is approximated by a Gaussian distribution. The beam monitor 123 will be described later. Based on the determined intensity and the determined spread of the intensity distribution, the intensity distribution of the synchrotron radiation on the surface of a wafer is determined by a correction method for causing the intensity of the synchrotron radiation which enters the mirror 102 and the spread of the intensity distribution, which are determined in advance, to be related to the intensity distribution of the synchrotron radiation on the wafer surface. This correction method will be described later.

The shutter controller 114 calculates the driving time of the shutter 103 on the basis of the intensity distribution of the synchrotron radiation on the wafer surface, and drives the shutter 103 on the basis of the calculated result. That is, the movement speed of the shutter 103 is controlled according to the intensity distribution of the synchrotron radiation on the wafer surface so that the amount of exposure on the wafer 105 becomes uniform.

A correction method for causing the intensity of synchrotron radiation which enters the mirror 102 and the spread of the intensity distribution to be related to the intensity distribution of the synchrotron radiation on the wafer surface is described below. Here, a method for determining correction equations is described.

Initially, by driving the X-ray detector 108 mounted in the mirror holder 106 in the Y direction, the intensity distribution of the synchrotron radiation which enters the mirror 102 is measured, and the spread of the intensity distribution is determined. That is, while the X-ray detectors 108*a* and 108*b* of the mirror holder 106 are driven in the Y direction, the outputs therefrom are amplified by the preamplifier 111, and the outputs Va and Vb thereof are converted into the intensity of the synchrotron radiation and the intensity distribution by the calculating unit 113. The calculating unit 113 further approximates the intensity distribution by an appropriate function, for example, a Gaussian function, in order to determine the spread of the intensity distribution. Also, at the same time, by driving the X-ray detector 119 mounted in the wafer stage in the Y direction, the intensity distribution of the synchrotron radiation on the wafer surface is measured. That is, while the X-ray detector 119 is driven In the Y direction, the output of the X-ray detector 119 is amplified by the preamplifier 120, and an output Vc thereof is converted into the intensity distribution of the synchrotron radiation by the calculating unit 121.

By performing this operation by changing the accumulated current value of the synchrotron radiation source, a plurality of pieces of data are taken, and an approximation curve is determined by plotting the intensity of the synchrotron radiation which enters the mirror 102 and the spread of the intensity distribution, and the intensity distribution of the synchrotron radiation on the wafer surface. This approximation curve is approximated by a polynominal equation. Instead of using this polynominal equation, a method may be used in which a table is stored in which the intensity of the synchrotron radiation which enters a mirror and the spread of the intensity distribution are made to correspond to the intensity distribution of the synchrotron radiation on the wafer surface, and compensation is performed by using this table.

Sixth Embodiment

Figure 12:
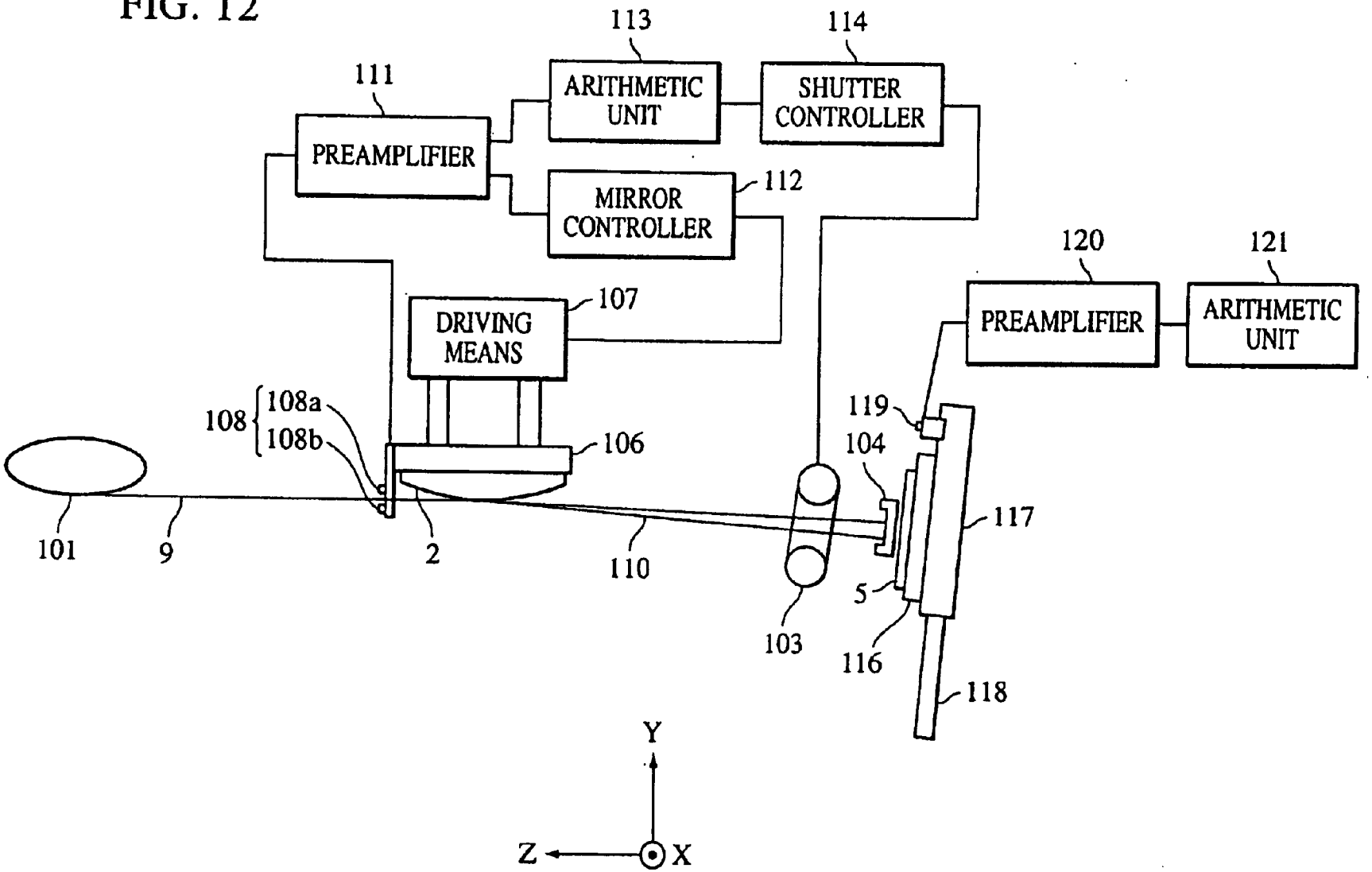
FIG. 12 is a schematic diagram of the construction of an X-ray exposure apparatus according to another embodiment of the present invention.

FIG. 12 is a diagram of the construction of an X-ray exposure apparatus according to another embodiment of the present invention. The construction of this embodiment is the same as that of FIG. 11, except that the beam monitor 123 is not used.

When exposure is performed, with respect to the sheet-shaped beam 9, the X-ray detector 108 of the mirror holder 106 is first driven in the Y direction. At this time, the outputs of the first and second X-ray detectors 108*a* and 108*b* are amplified by the preamplifier 111, and the amplified outputs Va and Vb thereof are sent to the calculating unit 113. The calculating unit 113 converts the output Va or Vb into the intensity of the synchrotron radiation (sheet-shaped beam 9) and the intensity distribution. The calculating unit 113 further approximates the intensity distribution by an appropriate function, such as a Gaussian function, in order to determine the spread of the intensity distribution.

Based on the intensity and the spread of the intensity distribution, the calculating unit 113 further determines the intensity distribution of the synchrotron radiation on the surface of the wafer 105 by a correction method of relating the intensity of the synchrotron radiation which enters the mirror 102 and the spread of the intensity distribution, which are determined in advance, to the intensity distribution of the synchrotron radiation on the surface of the wafer 105. The correction method of relating the intensity of the synchrotron radiation which enters the mirror 102 and the spread of the intensity distribution to the intensity distribution of the synchrotron radiation on the surface of the wafer 105 is the same as that of the first embodiment.

Then, the shutter controller 114 calculates the driving time of the shutter 103 on the basis of the intensity distribution of the synchrotron radiation on the surface of the wafer, and drives the shutter 103 on the basis of the calculated result. That is, the movement speed of the shutter 103 is controlled according to the intensity distribution of the synchrotron radiation on the surface of the wafer 105 so that the amount of exposure on the wafer 105 becomes uniform.

This embodiment is particularly effective in a case in which, although the intensity distribution of the synchrotron radiation which enters the mirror 102 changes independently of the attenuation of the accumulated current value over time after the incidence of the synchrotron radiation, the cycle of the change is moderate and, there is no variation while, for example, one wafer is exposed.

Seventh Embodiment

In the construction of FIG. 12, from the time the synchrotron radiation enters until the exposure starts, by driving the X-ray detector 108 of the mirror holder 106 in the Y direction, the intensity of radiation which enters the mirror 102 and the intensity distribution are measured, and the spread of the intensity distribution is determined. Also, at the same time as this, the present accumulated current value is determined in advance. This method for measuring the intensity and the intensity distribution, and for determining the spread of the intensity distribution, is the same as that of the second embodiment.

When exposure is performed, the intensity of the synchrotron radiation which enters the mirror 102, and the spread of the intensity distribution are determined from the present accumulated current value. This method will be described later.

Based on the present intensity of the synchrotron radiation which enters a mirror and the present intensity distribution, the calculating unit 113 determines the intensity distribution of the synchrotron radiation on the surface of the wafer 105 by a correction method of relating the intensity of the synchrotron radiation which enters a mirror and the spread of the intensity distribution, which are determined in advance, to the intensity distribution of the synchrotron radiation on the surface of the wafer 105. This correction method is the same as those of the first and second embodiments.

Then, in a manner similar to the case of the second embodiment, the shutter controller 114 calculates the driving time of the shutter 103 on the basis of the intensity distribution of the synchrotron radiation on the surface of the wafer 105, and drives the shutter 103 on the basis of the calculated result.

In practice, since the accumulated current value is proportional to the intensity of the synchrotron radiation which enters the mirror 102, the intensity of the synchrotron radiation is determined, and this is used instead as the accumulated current value.

Figure 13:
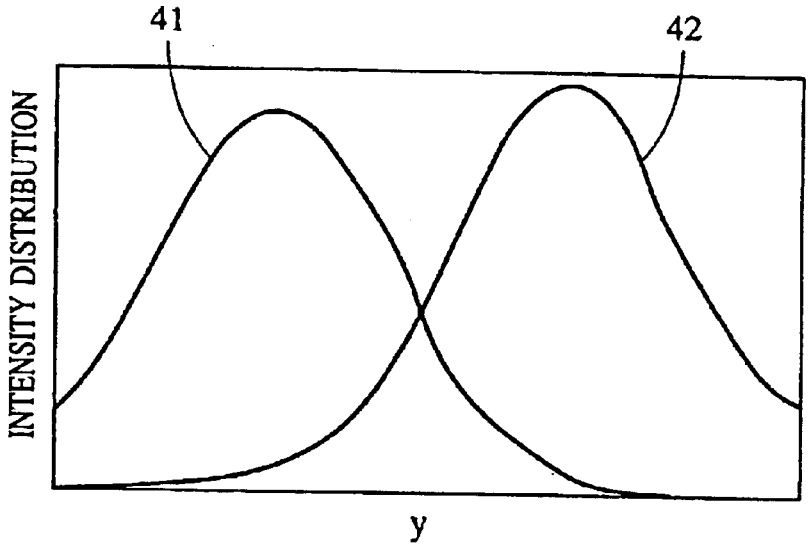
FIG. 13 is a graph showing the intensity distribution of measured synchrotron radiation.

A description is given below of a method for determining a correction equation for relating the accumulated current value of a synchrotron radiation source to the intensity of the synchrotron radiation which enters a mirror and the spread of the intensity distribution. FIG. 13 is a graph showing the intensity distribution of the sheet-shaped beam 9, which is obtained by plotting the outputs Va (y) and Vb (y) of the two X-ray detectors 108*a* and 108*b* when the cylindrical mirror 102 is driven in the Y direction by the driving means 107. A curve 41 in the figure indicates Va (y), and a curve 42 indicates Vb (y). These are approximated by a Gaussian distribution, the voltage of the intersection and the area are determined, and the spread of the intensity distribution is determined. The area has a value proportional to the intensity of the synchrotron radiation, and a conversion coefficient is determined in advance from the sensitivity, etc., of the X-ray detector 108. A plurality of pieces of data are taken by performing these operations by varying the accumulated current value of the synchrotron ring 101, and the voltage of the intersection, the intensity of the synchrotron radiation, and the intensity distribution are plotted.

Figure 14:
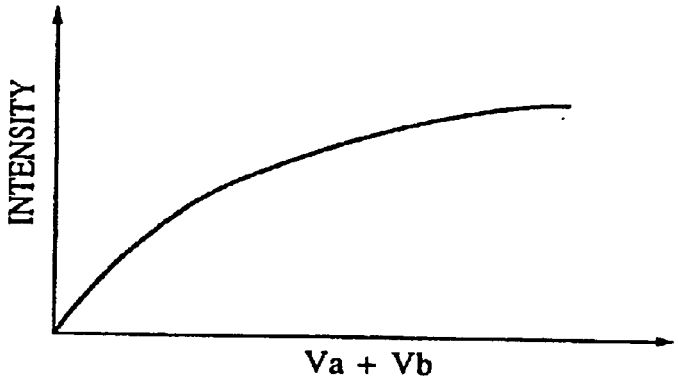
FIG. 14 is a graph showing the relationship between the summed signal of the outputs of X-ray detectors and the intensity of the synchrotron radiation.
Figure 15:
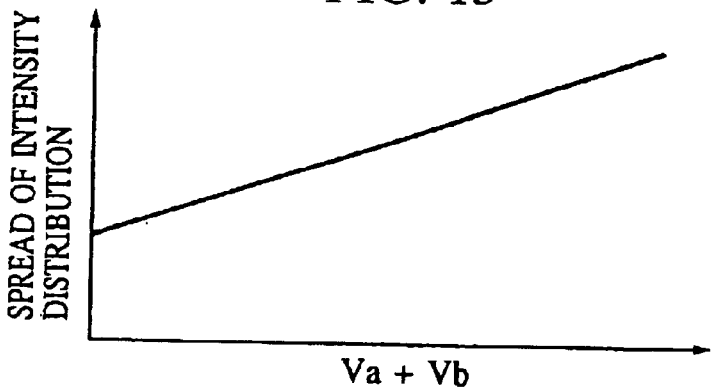
FIG. 15 is a graph showing the relationships between the summed signals of the outputs the X-ray detectors and the spread of the intensity distribution of the synchrotron radiation.

FIG. 14 shows the relationship, which is determined by the above, between the summed signal Va+Vb of the output of the X-ray detector 108, and the intensity of the synchrotron radiation. FIG. 15 shows the relationship, which is determined by the above-described method, between the summed signal Va+Vb of the output of the X-ray detector 108, and the spread of the intensity distribution of the synchrotron radiation. In this manner, the approximated curve and the approximated straight line are determined, and the coefficients therefor are stored in the calculating unit 113.

This embodiment is particularly effective in a case in which the intensity distribution of the synchrotron radiation which enters a mirror is determined by a fixed rule with respect to the attenuation of an accumulated current value over time.

It is known that SR light before it is reflected by the mirror 102 has a distribution similar to a Gaussian distribution and that the intensity of the center thereof is highest and falls off toward the periphery. It is also known that the SR light has an intensity distribution which is almost symmetrical with respect to the center, and in this case, the intensity distribution of the SR light is determined by the center intensity and the spread thereof. Accordingly, at least two of the total intensity, the center intensity, and the intensity at a position away by a particular distance from the center are measured by a specific method (a method described in the respective embodiments), and the correlation among the measured values and the intensity on the resist surface is determined in advance. The "total intensity" refers to the intensity such that the entire intensity distribution is integrated, and it can be measured at one time if the detector is sufficiently enlarged with respect to the incident SR light. In addition, before exposure, by measuring the intensity distribution of the SR light before a mirror by a specific method which is the same as the method in which at least two of the total intensity, the center intensity, and the intensity at a position away by a particular distance from the center are measured, the intensity distribution on the resist surface can be corrected. Instead of measuring at least two of the total intensity, the center intensity, and the intensity at a position away by a particular distance from the center, the entire intensity distribution may be determined.

Figure 16:
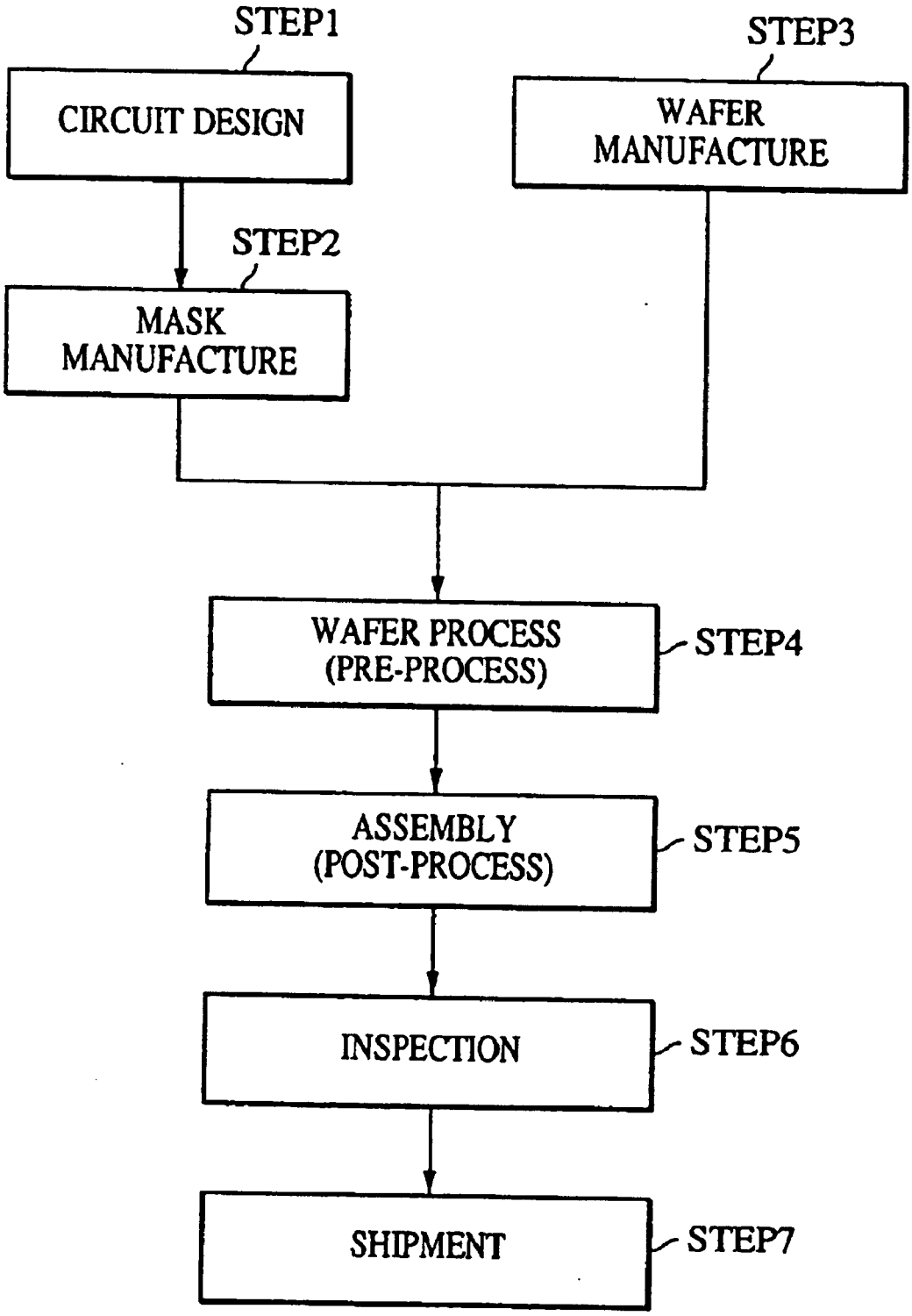
FIG. 16 is a flowchart showing semiconductor device manufacturing steps using an X-ray exposure apparatus of the present invention.

FIG. 16 is a flow chart showing a process for manufacturing a micro-device (e.g., a semiconductor chip such as an IC or an LSI, a liquid crystal panel, a CCD (charge-coupled device), a thin film magnetic head, a micro-machine or the like). At step 1 (circuit design), the circuit design of the semiconductor device is effected. At step 2 (the manufacturing of a mask), a mask, as the substrate described in the above embodiments, formed with the designed circuit pattern, is manufactured. On the other hand, at step 3 (the manufacturing of a wafer), a wafer is manufactured by the use of a material such as silicon. Step 4 (wafer process) is called a pre-process, in which by the use of the manufactured mask and wafer, an actual circuit is formed on the wafer by lithography techniques. The next step, step 5 (assembling), is called a post-process, which is a process for making the wafer manufactured at step 4 into a semiconductor chip, and includes steps such as an assembling step (dicing and bonding) and a packaging step (enclosing the chip). At step 6 (inspection), inspections such as an operation confirming test a durability test of the semiconductor device manufactured at step 5 are carried out. Via such steps, the semiconductor device is completed, and it is shipped for delivery (step 7).

Figure 17:
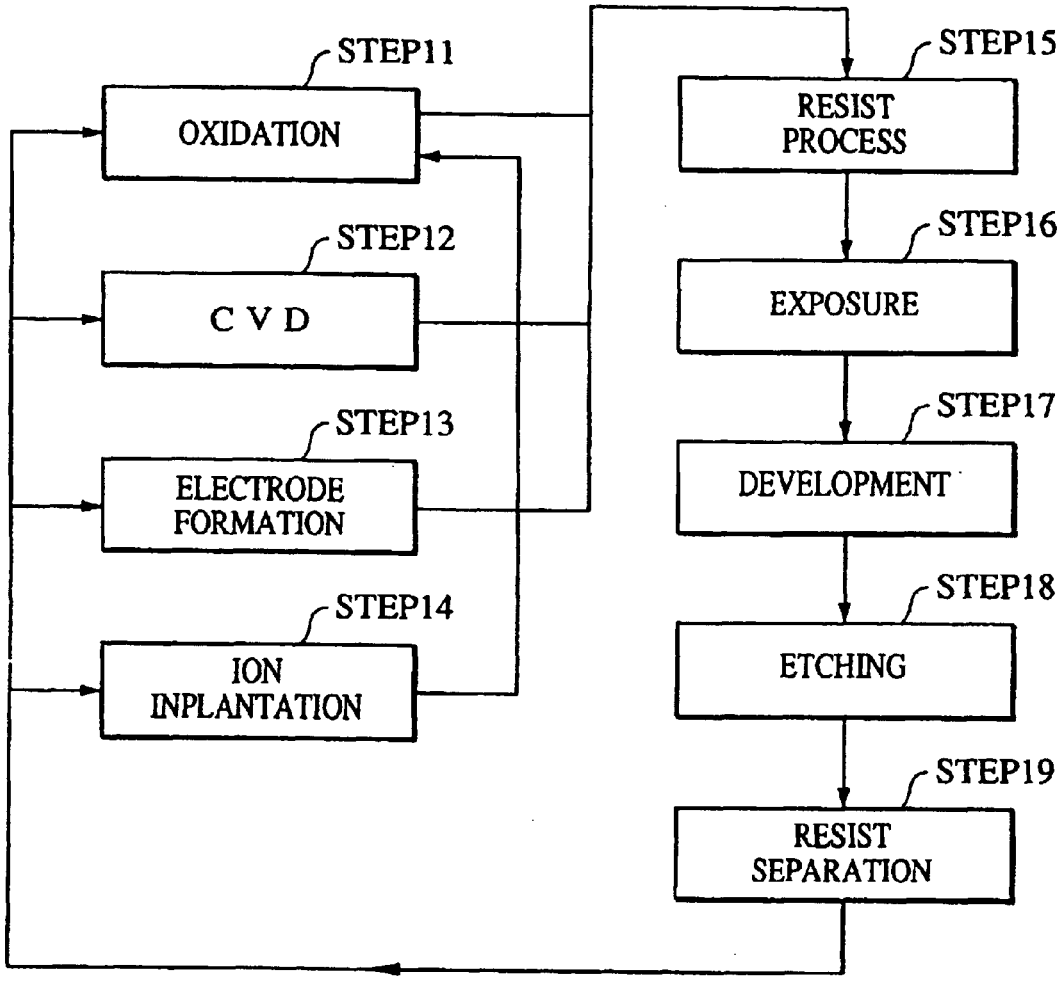
FIG. 17 is a flowchart showing a wafer processing in FIG. 16.
Figure 18:
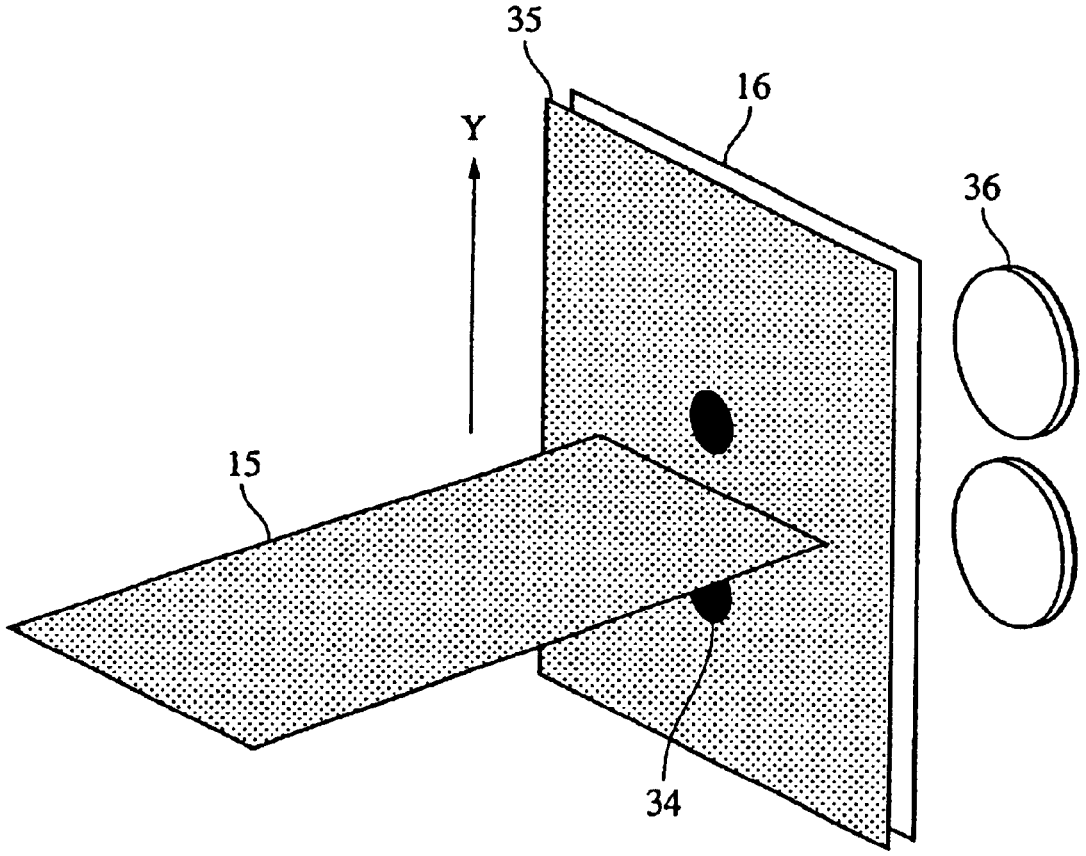
FIG. 18 PRIOR ART
FIG. 18 shows the construction of a conventional detector for synchrotron radiation measurement.
Figure 19:
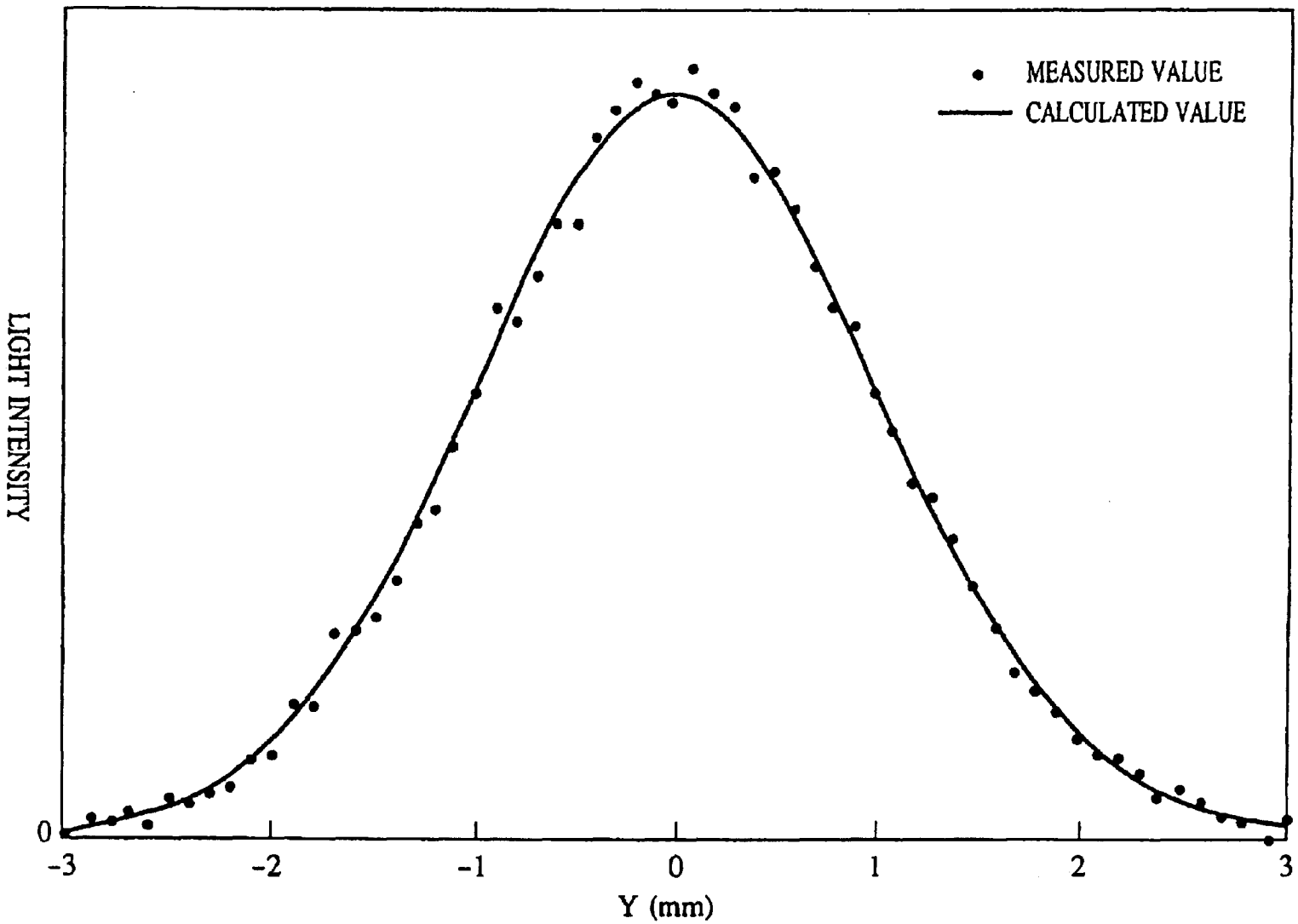
FIG. 19 PRIOR ART
FIG. 19 is a graph showing a method for calculating the spread a of a beam and the position thereof along the Y direction.

FIG. 17 is a flowchart showing the detailed steps of the wafer process discussed above with respect to step 4. At step 11 (oxidation), the surface of the wafer is oxidized. At step 12 (chemical vapor deposition—CVD), an insulating film is formed on the surface of the wafer. At step 13 (the forming of an electrode), an electrode is formed on the wafer by vapor deposition. At step 14 (ion implantation), ions are implanted into the wafer. At step 15 (resist-processing), a photo-resist is applied to the wafer. At step 16 (exposure), the circuit pattern of the mask is printed and exposed onto the wafer by the X-ray exposure apparatus. At step 17 (development), the exposed wafer is developed. At step 18 (etching), the portions other than the developed resist image are removed. At step 19 (the peeling-off of the resist), the resist, which has become unnecessary after the etching, is also removed. By repetitively carrying out these steps, circuit patterns are multiplexly formed on the wafer. If the manufacturing method of the present invention is used, it will be possible to manufacture semiconductor devices having a high degree of integration, which have heretofore been difficult to manufacture.

Except as otherwise disclosed herein, the various components shown in outline or in block form in the figures are individually well known and their internal construction and operation are not critical either to the making or using of this invention or to a description of the best mode of the invention.

While the present invention has been described with respect to what is at present considered to be the preferred embodiments, it is to be understood that the invention is not limited to the disclosed embodiments. To the contrary, the present invention is intended to cover various modifications and equivalent arrangements included within the spirit and scope of the invention as hereafter claimed.

What is claimed is:

1. A measurement apparatus comprising:

a first detector that measures an intensity of a line-shaped beam from a light source, said first detector configured such that the intensity of the line-shaped beam from the light source is integrated over the entire range of the beam in the vertical direction of the beam;

a second detector for measuring the intensity of the beam at a plurality of points where positions along the vertical direction of the beam are different; and a calculator for calculating a beam profile in the vertical direction of the beam on the basis of the detections by said first and second detectors.

2. A measurement method comprising the steps of:

measuring an intensity of a line-shaped beam, the intensity being integrated over the entire range of the beam in the vertical direction of the beam;

measuring the intensity of the beam at plurality of points where positions along the vertical direction of the beam are different; and calculating a beam profile in the vertical direction of the beam on the basis of the respective measumrents.

3. An exposure apparatus comprising:

a mirror for reflecting a beam from a light source;

a stage which holds a substrate to be exposed to the beam; and a measuring device disposed for measuring intensity distribution of the beam irradiating the substrate, the measuring device comprising:

a first detector that measures an intensity of a line-shaped beam, said first detector configured such that the intensity of the line-shaped beam is integrated over the entire range of the beam in the vertical direction of the beam;

a second detector for measuring the intensity of the beam at a plurality of points where positions along the vertical direction of the beam are different; and calculating means for calculating a beam profile in the vertical direction of the beam on the basis of the detections by said first and second detectors.

4. An exposure apparatus comprising:

a mirror for reflecting a beam from a light source;

a stage which holds a substrate to be exposed to the beam; and a measuring device having a measuring method for measuring intensity distribution of a line-shaped beam irradiating the substrate, the measuring method comprising:

measuring an intensity of a line-shaped beam, the intensity being integrated over the entire range of the beam in the vertical direction of the beam;

measuring the intensity of the beam at a plurality of points where positions along the vertical direction of the beam are different; and calculating a beam profile in the vertical direction of the beam on the basis of the respective measurements.

* * * * *

UNITED STATES PATENT AND TRADEMARK OFFICE

CERTIFICATE OF CORRECTION

PATENT NO. : 6,847,696 B2
DATED : January 25, 2005
INVENTOR(S) : Hideyuki Chinju et al.

It is certified that error appears in the above-identified patent and that said Letters Patent is hereby corrected as shown below:

Title page,
Item [75], Inventors, "Nobuaki Oqushi" should read -- Nobuaki Ogushi --.

Column 1,
Line 18, "radiation" should read -- radiation, --.
Line 20, "field" should read -- field, --.

Column 5,
Line 26, "two." should read -- two --.

Column 6,
Line 2, "Increased," should read -- increased, --.

Column 8,
Line 28, "ate" should read -- are --.

Column 9,
Line 8, "Intensity" should read -- intensity --.

Column 17,
Line 5, "what is" should read -- what are --.
Line 32, "measumrents." should read -- measurements. --.

Signed and Sealed this

Seventh Day of February, 2006

JON W. DUDAS
*Director of the United States Patent and Trademark Office*